United States Patent [19]

Goffinet

[11] 4,149,978

[45] Apr. 17, 1979

[54] TEXTILE TREATMENT COMPOSITION

[75] Inventor: Pierre C. E. Goffinet, Brussels, Belgium

[73] Assignee: The Procter & Gamble Company, Cincinnati, Ohio

[21] Appl. No.: 921,145

[22] Filed: Jun. 30, 1978

[30] Foreign Application Priority Data

Jul. 12, 1977 [GB] United Kingdom ..... 29238/77

[51] Int. Cl.[2] ..... D06M 13/34

[52] U.S. Cl. ..... 252/8.8; 8/115.6; 252/8.6

[58] Field of Search ..... 252/8.8, 8.6; 8/115.6

[56] References Cited

U.S. PATENT DOCUMENTS

| | | | |
|---|---|---|---|
| 2,956,950 | 10/1960 | Hall | 252/8.8 |
| 3,660,303 | 5/1972 | Hiestand | 252/8.8 UX |
| 3,896,033 | 7/1975 | Grimm | 252/8.8 |
| 3,971,733 | 7/1976 | Hawkins | 252/8.8 |
| 3,983,272 | 9/1976 | Huber | 252/8.6 |

*Primary Examiner*—William E. Schulz

[57] ABSTRACT

Textile treatment compositions comprise a water-insoluble cationic fabric softener and $C_{12}$–$C_{40}$ hydrocarbon, optionally together with a water-soluble cationic surfactant. In two component systems, the ratio of cationic softener to hydrocarbon is from 5:1 to 1:3. Preferred hydrocarbon materials have from 14 to 18 carbon atoms and with such materials, highly concentrated fabric softeners can be prepared.

17 Claims, No Drawings

TEXTILE TREATMENT COMPOSITION

This invention relates to textile treatment compositions and, in particular, to compositions in aqueous medium and based on mixtures of cationic fabric softeners and certain hydrocarbon materials.

Conventional rinse-added fabric softeners contain fabric softening agents which are cationic materials such as distearyl dimethyl ammonium chloride. The positive charge on the softening compound encourages its deposition onto the fabric substrate, the surface of which is usually negatively charged.

However, although the above-mentioned cationic compounds are highly effective softeners when applied in a rinse solution, there are certain disadvantages associated with their use. For example, the cationic compounds having long alkyl chains are very sensitive to carry over of anionic detergent into the rinse. Thus, carry over of anionic detergent tends to neutralize the softening effect because the anionic-cationic complex tends to precipitate out of solution. Also, certain cationic surfactant compounds are expensive and in short supply and it is therefore desirable, for commercial reasons, to provide softening compositions having a reduced amount of cationic surfactant compound. Furthermore, softening compositions which comprise predominantly long chain cationic compounds have the disadvantage that the treated fabrics tend to become overloaded with softener and become discoloured, greasy or undesirably non-absorbent.

The German Offenlegungsschrift No. 26 31 114 discloses fabric softening compositions based on mixtures of cationic and nonionic materials. While these compositions overcome the problems referred to above, they suffer from the disadvantage that many of the nonionic materials (mainly esters and ethers) tend to be relatively expensive and for commercial reasons, it is desirable to utilize less expensive materials.

The present invention is based on the recognition that certain hydrocarbon materials in combination with specific cationic materials provide excellent alternative softening compositions having good stability and showing enhanced performance in the area of ease-of-ironing and anti-wrinkling.

Hydrocarbon materials such as paraffin oils and paraffin waxes are known to have a softening or lubricating effect when applied to textile fibres and fabrics; see, for example, Melliand Textilberichte, 1947, 28, 61-2 and J. Soc. Textile Cellulose Ind. (Japan), 1954, 10, 229. Cationic emulsions containing paraffin materials and used in textile finishing are also disclosed in Belgian Pat. No. 617,008, French Pat. No. 1,554,951 and U.S. Pat. No. 2,956,950.

The U.S. Pat. No. 3,222,213 discloses automobile rinsing compositions comprising mixtures of a cationic surfactant and an emulsifiable mineral oil. British Pat. No. 1,055,344 relates to the use of certain long-chain waxes having a melting point of over 95° C. in combination with an ethoxylated cationic surfactant for lubricating textile fibres.

Compositions of the above types are generally well-adapted for direct application to textile fibres or fabrics in order to impart some degree of lubricity. However, when it is desired to utilize such hydrocarbon materials in softening compositions adapted for rinse-added use in domestic laundering, it is necessary to combine the materials with certain specific types of cationic materials, in order to effect emulsification of the hydrocarbon and to achieve the necessary deposition from dilute solution.

It is an object of the present invention to provide an aqueous fabric softening composition that provides good textile softening when used in a rinse-added method.

It is a further object of the invention to provide an aqueous composition containing a mixture of cationic textile softener and hydrocarbon which is in the form of a fine or micro-emulsion.

According to the present invention, there is provided a textile treatment composition in aqueous medium and comprising a water-insoluble cationic fabric softener and a $C_{12}$ to $C_{40}$ hydrocarbon. Highly preferred hydrocarbons are the $C_{12}$ to $C_{24}$, especially $C_{14}$ to $C_{18}$, alkanes and alkenes. Mixtures of $C_{14}$ to $C_{18}$ n-paraffin (which are liquid at room temperature) are especially useful.

When the composition consists substantially of only the two active ingredients, i.e. the cationic softener and the hydrocarbon (together with any minor ingredients such as perfume, dye, etc.), the weight ratio of cationic softener to hydrocarbon is from 5:1 to 1:3. However, in certain compositions, it can be desirable to include a water-soluble cationic surfactant, preferably an ethoxylated diamine salt. In such compositions, the weight ratio of softener to hydrocarbon is less critical, although the above range is still preferred.

The total active system (cationic softener, cationic surfactant, if any, and hydrocarbon) normally makes up from 2% to 60% of the composition, preferably from 4% to 40%.

The essential components of the invention will now be described in more detail. In the specification, the "percent" indications mean percent by weight of the composition, unless otherwise stated.

The water-insoluble cationic fabric softener can be any fabric-substantive cationic compound the acid salt form of which has a solubility in water at pH 2.5 and 20° C. of less than 10 g./l. Highly preferred materials are quaternary ammonium salts having two $C_{10}$–$C_{22}$ alkyl chains, optionally substituted or interrupted by functional groups such as —OH, —O—, —CONH, —COO—, etc.

Well-known species of substantially water-insoluble quaternary ammonium compounds have the formula

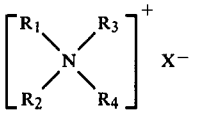

wherein $R_1$ and $R_2$ represent hydrocarbyl groups of from about 10 to about 22 carbon atoms; $R_3$ and $R_4$ represent hydrocarbyl groups containing from 1 to about 4 carbon atoms; and X is an anion, preferably selected from halide, and methyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconutalkyl) dimethyl ammonium chloride. Ditallow dimethyl ammonium chloride, di(hydrogenated tallow alkyl) dimethyl ammonium chloride and di(coconut alkyl) dimethyl ammonium chloride and di(coconut alkyl) dimethyl ammonium chloride are preferred.

Another class of suitable water-insoluble cationic materials are the alkylimidazolinium salts believed to have the formula

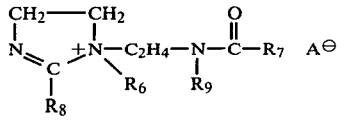

wherein $R_6$ is an alkyl containing from 1 to 4, preferably 1 or 2 carbon atoms, $R_7$ is an alkyl containing from 9 to 25 carbon atoms, $R_8$ is an alkyl containing from 8 to 25 carbon atoms, and $R_9$ is hydrogen or an alkyl containing from 1 to 4 carbon atoms. Preferred imidazolinium salts include 1-methyl-1-[(tallowylamido-)ethyl]-2-tallowyl-4,5-dihydroimidazolinium methyl sulfate (commercially available under the trade name VARISOFT 475, from ASHLAND CHEMICAL Company) and 1-methyl-1-[(palmitoylamido)ethyl]-2-octadecyl-4,5-dihydroimidazolinium chloride. The material sold by REWO under the Trade Name STEINAQUAT M 5040 H is also a preferred material. Also suitable herein are the imidazolinium fabric softening components of Belgian Pat. No. 854,803, incorporated herein by reference. $A^-$ is an anion having the meaning given above, preferably a halide or a methosulfate.

It has been noted that compositions including an imidazolinium salt as the sole or major cationic component have excellent physical properties (in particular have little tendency to gel) and this enables concentrated compositions to be prepared more easily. In particular, when compositions containing up to 60%, preferably from 15% to 40%, of active ingredients are desired, then imidazolinium salts are highly preferred and can be utilized in such compositions together with the hydrocarbon material in the absence of a soluble cationic surfactant. As will be later described, the incorporation of a soluble cationic surfactant enables concentrated compositions to be prepared even when a nonimidazolinium quaternary salt is employed as the cationic softening agent.

The concentrated binary compositions discussed above can enable a greater level of softening performance to be achieved than is possible with a composition based only on cationic softener. Such binary compositions also also very much more cost effective than conventional softeners based only on cationic materials.

The other essential component of the compositions of the present invention is a hydrocarbon material having from about 12 to 40 carbon atoms. Preferred materials have from 12 to 24 carbon atoms and especially preferred are liquid mixtures of paraffins having from 14 to 18 carbon atoms.

Normally, suitable hydrocarbons are found in the paraffin and olefin series, but other materials, such as alkynes and cyclic hydrocarbons are not excluded. Materials known generally as paraffin oil, soft paraffin wax and petrolatum are suitable. Examples of specific materials are hexadecane, octadecane, eicosane and octadecene. Preferred commercially-available paraffin mixtures include spindle oil and light oil and technical grade mixtures of $C_{14}/C_{18}$ n-paraffins.

Useful compositions of the present invention can be binary mixtures of the two above-discussed essential ingredients in water. Such compositions are in the form of an emulsion or dispersion. Frequently, for practical reasons of viscosity and phase stability, such two-component systems are relatively dilute, containing from 2% to 15%, preferably from 4% to 8% of the binary mixture of cationic softener and hydrocarbon. However, as explained above, especially when an imidazolinium salt is employed as the insoluble cationic softener, more concentrated binary mixtures are possible, for example containing 15% to 40% of the mixture, preferably 25% to 35%.

In such binary mixtures, the ratio of cationic material to hydrocarbon is preferably from 5:1 to 1:3, more preferably from 1.25:1 to 1:3, for example 1:1.5.

Especially in these binary systems, the ratio of cationic fabric softener to hydrocarbon is critical for good results. In particular, if the proportion of cationic material is too low, then there is incomplete deposition of the active softening ingredients onto the fabric surface and softening performance is therefore less good.

In addition to the above-discussed two essential active components, compositions according to the invention can also include a water-soluble cationic surfactant.

By water-soluble, it is meant that the cationic surfactant has a solubility in water of pH 2.5 and 20° C. of greater than 10 g./l. Normally such materials are ammonium salts having one $C_{12}$–$C_{24}$ alkyl chain, optionally substituted or interrupted by functional groups such as —O—, —COO—, —CONH—, —OH— etc.

Compositions including such water-soluble materials can be made in more concentrated form even when based on non-imidazolinium softeners and, uniquely, often exist in the form of microemulsions or emulsions of very small ($<1\mu$) particle size; this allows unusual aesthetic effects to be achieved.

Although mono-ammonium materials such as cetyltrimethylammonium bromide and stearyldimethylamine hydrochloride are not excluded, highly preferred water-soluble cationic materials are the polyamine materials represented by the general formula

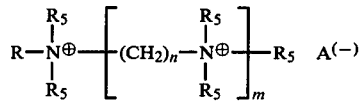

wherein R is selected from an alkyl or alkenyl group having from 10 to 24, preferably from 16 to 20 carbon atoms in the alk(en)yl chain, and $R—O—(CH_2)_n—$; each $R_5$ is independently selected from hydrogen, $—(C_2H_4O)_pH$, $—(C_3H_6O)_qH$, $—(C_2H_4O)_r(C_3H_6O)_sH$, a $C_{1-3}$ alkyl group and the group $—(CH_2)_n—N(R')_2$, wherein R' is selected from hydrogen, $—(C_2H_4O)_pH$, $—(C_3H_6O)_pH$, $—(C_2H_4O)_p(C_3H_6O)_qH$ and $C_{1-3}$ alkyl; n is an integer from 2 to 6, preferably 2 or 3; m is an integer from 1 to 5, preferably 1 or 2; p,q,r and s are each a number such that the total p+q+r+s in the molecule does not exceed 25 (preferably, each p and q is 1 or 2 and each r and s is 1); and $A^{(-)}$ represents one or more anions having total charge balancing that of the nitrogen atoms.

Preferred water-soluble cationic materials are alkoxylated and contain not more than one $—C_2H_4OH$ or $—C_3H_6OH$ group attached to each nitrogen atom, except that up to two of these groups can be attached to a terminal nitrogen atom which is not substituted by an alkyl group having from 10 to 24 carbon atoms. Such ethoxylated species are especially useful in preparing the microemulsion form of the present compositions.

Polyamine species suitable for use herein include:

N-tallowyl,N,N',N'-tris(2-hydroxyethyl)1,3-propanediamine di-hydrochloride;

N-soybean alkyl 1,3-propane diammonium sulfate;

N-stearyl-N,N'-di(2-hydroxyethyl)-N'-(3-hydroxypropyl)-1,3-propanediamine dihydrofluoride;

N-cocoyl N,N,N',N',N'-pentamethyl-1,3-propane diammonium dichloride or dimethosulfate;

N-oleyl N,N',N'-tris(3-hydroxypropyl)-1,3-propanediamine dihydrofluoride;

N-stearyl N,N',N'-tris(2-hydroxyethyl) N,N'-dimethyl-1,3-propanediammonium dimethylsulfate;

N-palmityl N,N',N'-tris(3-hydroxypropyl)-1,3-propanediamine dihydrobromide;

N-(stearyloxypropyl) N,N',N'-tris(3-hydroxypropyl)1,3-propanediammonium diacetate;

N-tallowyl N-(3-aminopropyl)1,3-propanediamine trihydrochloride;

N-oleyl N-[N'',N'' bis(2-hydroxyethyl)3-aminopropyl]N',N'-bis(2-hydroxyethyl)1,3 diaminopropane trihydrofluoride.

It is understood that the polyamines can also be represented by components comprising a heterocyclic moiety resulting from internal cyclization of the polymaines having the general formula indicated above. The cyclization can be produced in reacting the polyamines with formic acid followed by thermal dehydration. Typical examples of suitable polyamines containing such a heterocyclic moiety are:

1-[N-hydrogenated tallowylaminopropyl]-pentahydropyridinium dihydrochloride;

1-[N-stearylaminopropyl]-5-(hydroxyethyl)-tetrahydropyridinium sulfate.

$A^{(-)}$ may represent a halide or any appropriate acidic radical such as a di-acetate, or higher saturated or unsaturated acyl groups up to $C_{22}$, and in general any suitable nitrogen charge balancing anion. Preferred nitrogen charge balancing anions can be represented by halides, $C_{1-22}$alkyl, $C_1$–$C_{16}$ alkylaryl, arylsulf(on)ates, arylcarboxylates and $C_1$–$C_{12}$ alkylcarboxylates. Examples of the preferred charge balancing anions include: fluoride, bromide, chloride, methyl sulfate, toluene-, xylene-, cumene-, and benzene-sulfonate, dodecyl-benzenesulfonate, benzoate, parahydroxybenzoate, acetate, propionate and laurate.

The water-soluble cationic surfactant herein can be represented by alkyl pyridinium salts having the following formula

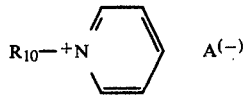

wherein $R_{10}$ is a $C_{10}$-$C_{24}$, preferably $C_{16}$ or $C_{18}$ alkyl radical, and $A^{(-)}$ is a suitable anion as defined hereinbefore, preferably a halide, especially chloride or bromide.

Individual species of the fabric-substantive agent can be used as well as mixtures thereof. For example, a combination of differently substituted mixtures of polyamines can be used or a mixture of polyamine(s) and alkylpyridinium salts. It should be understood that references to polyamine salts are intended to include both fully and partially neutralized materials.

As already indicated, the compositions having a ternary active system are often either micro-emulsions or emulsions of fine particle size. The other advantage of the ternary system, especially when an ethoxylated amine salt is used, is that highly concentrated compositions (20%–60%, especially 25%–35% active) can be prepared. In the concentrated executions where the fabric softener composition has a ternary active system (namely the water-insoluble cationic agent, the water-soluble cationic agent and the hydrocarbon material), the ternary active mixture contains from about 25% to about 65%, more preferably from 30% to 45% of the water-soluble cationic, from about 8% to about 35%, more preferably from 15% to 25% of the water-insoluble cationic, and from about 15% to about 65%, more preferably from 30% to 60% of the hydrocarbon. Preferably the weight ratio of the water-insoluble cationic softening component to the hydrocarbon is equal to or less than 1, preferably less than 0.7.

In concentrated compositions based on the binary mixture of an imidazolinium softener and a hydrocarbon, a relatively small amount of the water-soluble cationic surfactant can be employed in order to achieve particular aesthetic effects, e.g. to obtain translucent emulsions. Such compositions can, for example, contain from 2% to 10% by weight of the total active mixture of a water-soluble cationic.

In more dilute compositions having the ternary active system, the water-soluble cationic material can be present in relatively small amounts. In such compositions, the ratio of total cationic material to hydrocarbon should preferably be from 3:1 to 2:3.

In addition to the above-mentioned components, compositions of the present invention can also include the nonionic fabric softeners disclosed in German Offenlegungsschrift No. 26 31 114, the disclosure of which is incorporated herein by reference. Highly preferred additional softeners are glycerol monostearate and sorbitan monostearate.

In addition to the above-mentioned components, the compositions may contain other textile treatment or conditioning agents. Such agents include silicones, as for example described in German Pat. application DOS 26 31 419 incorporated herein by reference.

The optional silicone component can be used in an amount of from about 0.5% to about 6%, preferably from 1% to 4% of the softener composition.

The compositions herein can contain other optional ingredients which are known to be suitable for use in textile softeners at usual levels for their known function. Such adjuvants include emulsifiers, perfumes, preservatives, germicides, viscosity modifiers, colorants, dyes, fungicides, stabilizers, brighteners, and opacifiers. These adjuvants, if used, are normally added at their conventional low levels (e.g., from about 0.1% to 5% by weight).

The compositions can normally be prepared by mixing the ingredients together in water, heating to a temperature of about 60° C. and agitating for 5–30 minutes.

It is highly preferred and generally provides better performance, first to mix the cationic components either in neutralized or un-neutralized form into the molten hydrocarbon, and then disperse the mixture in the aqueous carrier medium (containing the necessary quantity of acid for the partial or total neutralization of the cationic) with good agitation. Depending upon the particular selection of materials, it may be necessary in certain cases to include other emulsifying ingredients or to employ more efficient means for dispersing and emulsifying the particles (e.g., high speed blender).

At 60° C., most of the water-insoluble materials useful herein exist in liquid form and therefore form liquid/liquid phase emulsions with an aqueous continuous phase. On cooling, the disperse phase may wholly or partially solidify so that the final composition exists as a dispersion which is not a true liquid/liquid emulsion. It will be understood that the term "dispersion" means liquid/liquid phase of solid/liquid phase dispersions and emulsions.

The pH of the compositions is generally adjusted to be in the range from about 3 to about 8, preferably from about 4 to about 6. In this preferred pH range, it will be understood that the neutralization of amines or polyamines in the composition can be incomplete.

When compositions of the present invention are added to the rinse liquor, a concentration from about 10 ppm to 1000 ppm, preferably from about 50 ppm to about 500 ppm, of total active ingredient is appropriate.

The following examples illustrate the invention.

EXAMPLE 1

N-tallowyl N,N',N'-tris(2-hydroxyethyl)-1,3-propane diamine (10 g.), octadecane (30 g.) and ditallowyl dimethyl ammonium chloride were premixed in the form of a melt at about 50° C., then added to a water seat at 55° C. containing about 4 g. of benzoic acid and agitated for 20 minutes. The dispersion was made up to 1000 ml., and contained 2.3% of ditallowdimethyl ammonium chloride (DTDMAC), 3% of octadecane and 1.4% of the diamine benzoate.

This composition gave excellent softening performance and was in the form of an emulsion with very small particle size.

In exactly the same manner, a composition in which octadecene-1 replaced the octadecane was prepared and gave equal performance.

EXAMPLE 2

Using the same procedure as Example 1, a composition was prepared containing 4.0% of octadecane, 2.5% of DTDMAC and 1.5% of N-tallowyl-N,N',N'-tris(2-hydroxyethyl)-1,3-propane diamine.

EXAMPLE 3

Following the procedure of Example 1, a composition was prepared having 5% of DTDMAC and 4% of octadecane in aqueous dispersion. This composition was in the form of a relatively coarse emulsion.

The compositions of Examples 2 and 3 both gave an excellent softening benefit on fabrics rinsed in a dilute solution of the compositions.

EXAMPLE 4

A concentrated liquid fabric softener was prepared having the composition listed hereinafter. The octadecane was melted and kept at 55° C. The ditallowdimethylammoniumchloride and the N-tallowyl-N,N'-, N'-tri(2-hydroxyethyl)-1,3 propane diamine (unneutralized) were dispersed, with stirring, in the molten octadecane to form the active material premix. This premix was then dispersed with vigorous stirring in a water seat having a temperature of about 50° C. Prior to adding the premix, hydrochloric acid and minor ingredients were added to the water seat to adjust the pH of the liquid softener composition to 4.5 (measured at 20° C.).

| INGREDIENTS | PARTS BY WEIGHT |
|---|---|
| N-tallowyl-N,N',N'-tri(2-hydroxyethyl)-1,3-propanediamine dihydrochloride | 12 |
| Ditallowyldimethylammoniumchloride | 4 |
| Octadecane | 16 |
| Water and minor ingredients | balance to 100 |

The concentrated composition of this invention was easily pourable at ambient temperature after preparation and after prolonged storage. The composition showed excellent phase stability and homogeneity after a 2 weeks storage.

This composition also shows excellent fabric rinse-softener properties either on adding to the rinse in its concentrated form thereby reducing the quantity to be added to thus take into account the higher level of actives, or after predilution to the usual liquid rinse softener concentration (5% to 8%).

Substantially comparable fabric-softener performance can be obtained from the compositions of examples 1,2 and 4 wherein the N-tallowyl-N,N',N'-tri(2-hydroxyethyl)-1,3 propanediamine is replaced with an equivalent amount of any of the following polyamines.

N-soybean alkyl-1,3-propane diammonium sulfate;

N-stearyl-N,N'-di(2-hydroxyethyl)-N'-(3-hydroxypropyl)-1,3-propanediamine dihydrofluoride;

N-cocyl N,N,N',N'.N'-pentamethyl-1,3-propane diammonium dichloride or dimethosulfate;

N-oleyl N,N',N'-tris(3-hydroxypropyl)-1,3-propanediamine dihydrofluoride;

N-stearyl N,N',N'-tris(2-hydroxyethyl) N,N'-dimethyl-1,3-propanediammonium dimethylsulfate;

N-palmityl N,N',N'-tris(3-hydroxypropyl)-1,3-propanediamine dihydrobromide;

N-(stearyloxypropyl) N,N',N'-tris(3-hydroxypropyl)1,3-propanediammonium diacetate;

N-tallowyl N-(3-aminopropyl)1,3-propanediamine trihydrochloride;

N-oleyl N-[N'',N'' bis(2-hydroxyethyl)3-aminopropyl]N',N'-bis(2-hydroxyethyl)1,3 diaminopropane trihydrofluoride.

1-[N-hydrogenated tallowylaminopropyl]-pentahydropyridinium dihydrochloride;

1-[N-stearylaminopropyl]-5-(hydroxyethyl)-tetrahydropyridinium sulfate.

EXAMPLE 5

A concentrated liquid fabric softener having the following composition was prepared by dispersing the paraffin mixture and Steinaquat 5040 H into a water seat at 50° C.

| INGREDIENTS | PARTS BY WEIGHT |
|---|---|
| Steinaquat M 5040H (a ditallow imidazolinium salt) | 12 |
| Technical grade mixture of $C_{15}$—$C_{18}$ n-paraffins(m.pt. 4° C.) | 18 |
| Water & miscellaneous | to 100 |

This composition gave very superior softening performance when employed at normal concentrations and fabrics rinsed therein also showed a significant benefit for anti-wrinkling and ease-of-ironing when compared with fabrics softened in a conventional all-cationic composition.

EXAMPLE 6

A composition was prepared as in Example 5 except that the 12 parts of the Steinaquat were replaced by 11 parts of Steinaquat and 1 part of DTDMAC. The presence of the small quantity of DTDMAC improved viscosity control of the composition.

EXAMPLE 7

In an analogous manner to that of Example 5, an aqueous composition was prepared containing 14% of the $C_{14}$–$C_{18}$ paraffin mixture and 12% of Steinaquat 5040.

This composition also provided excellent softening together with an ironing and anti-wrinkling benefit. The following are further examples of the invention.

| | EXAMPLE No. | | | | | | |
|---|---|---|---|---|---|---|---|
| | 8 % | 9 % | 10 % | 11 % | 12 % | 13 % | 14 % |
| Ingredients | | | | | | | |
| DTDMAC | | 5 | 2.3 | 3 | — | 4 | — |
| Varisoft 475 | 6 | | | — | 2 | — | — |
| Stearyl-benzyl-ammonium chloride | — | — | — | — | — | — | 4 |
| Octadecane | 3 | — | 2 | — | — | — | 3 |
| $C_{24}$—$C_{30}$ paraffin wax | — | 4 | — | 5 | — | — | — |
| $C_{16}$—$C_{24}$ paraffin wax | — | — | — | — | 4 | 2 | — |
| Glycerol monostearate | — | — | 1 | — | — | 1 | — |
| Sorbitan monostearate | — | — | — | 2 | — | — | 1 |
| N-stearylpropylene diamine | — | — | — | — | 2 | — | 2 |
| N-tallowyl N,N',N'-tris(2-hydroxyethyl)1,3-propane-diamine | — | — | 1 | 4 | — | — | — |
| N-stearyl N,N',N'-tris(2-hydroxyethyl)N,N'-dimethyl-1,3-propanediammonium dimethylsulphate | — | — | — | — | 1 | 2 | — |
| Benzoic acid | — | — | 0.4 | 1.2 | 0.6 | — | 0.4 |
| Water | | | to 100 | | | | |

A series of concentrated liquid fabric softeners of the invention have the following compositions.

| EXAMPLE No. | 15 | 16 | 17 | 18 | 19 | 20 | 21 |
|---|---|---|---|---|---|---|---|
| INGREDIENTS | | | | | | | |
| N-oleyl-N,N',N'-tri(3-hydroxy-propyl)-1,3-propanediamine di-hydrochloride | 8 | — | — | — | — | 20 | — |
| N-tallowyl-N,N',N'-tri(2-hydroxyethyl)-1,3-propanedi-amine dihydrochloride | — | 36 | — | — | 16 | — | — |
| N-soybean alkyl-1,3-propanedi-ammonium sulfate | — | — | 22 | — | — | — | — |
| N-cocoyl-N,N',N',N'-pentamethyl-1,3-propanediammonium dimetho-sulfate | — | — | — | 10 | — | — | 12 |
| Ditallowyldimethylammonium chloride | 6 | 6 | 3 | 6 | 5 | 8 | 5 |
| Octadecane | 12 | 12 | 10 | — | 4 | — | 14 |
| $C_{20}$—$C_{24}$ paraffins | — | — | — | 12 | | 18 | — |
| Glyceryl monostearate | — | — | — | — | 8 | — | — |
| and minor ingredients | | | balance to 100 | | | | |

A further series of concentrated softeners have the following compositions.

| EXAMPLE No. | 22 | 23 | 24 | 25 | 26 |
|---|---|---|---|---|---|
| INGREDIENTS | | | | | |
| Varisoft 475 | | 15 | | 10 | |
| Steinaquat 5040 | | | 8 | 14 | 14 |
| Octadecane | | 12 | | | |
| $C_{14}$—$C_{18}$ paraffin mixture | | | 18 | 18 | 8 | 22 |

-continued

| EXAMPLE No. | 22 | 23 | 24 | 25 | 26 |
|---|---|---|---|---|---|
| N-tallowyl-N,N',N',N'-tri(2-hydroxy-ethyl)-1,3-propane diamine dihy-drochloride | | | 3 | | 2 |
| Water & Minor | | | to 100 | | |

The compositions of examples 15–26 show excellent phase stability, homogeneity, pourability and dispersability after a prolonged storage.

What is claimed is:

1. A textile treatment composition in aqueous medium and comprising a water-insoluble cationic fabric softener and a $C_{12}$–$C_{40}$ hydrocarbon, in a weight ratio of cationic softener to hydrocarbon of from 5:1 to 1:3.

2. A composition according to claim 1 wherein the cationic fabric softener is a quaternary ammonium salt having two $C_{12}$–$C_{24}$ alkyl chains.

3. A composition according to claim 2 wherein the cationic fabric softener is selected from (1) compounds of the general formula $R_1R_2R_3R_4N^{(+)}X^{(-)}$ wherein $R_1$ and $R_2$ are each selected from $C_{12}$–$C_{24}$ alkyl, $R_3$ and $R_4$ are each selected from $C_1$–$C_4$ alkyl, and $X^{(-)}$ is an anion, (2) di $C_{12}$–$C_{24}$ alkyl imidazolinium salts and (3) mixtures thereof.

4. A composition according to claim 2 wherein the hydrocarbon is a paraffin or an olefin.

5. A composition according to claim 4 wherein the number of carbon atoms in the paraffin or olefin is from 16 to 24.

6. A composition according to claim 1 wherein the cationic fabric softener is a di-$C_{12}$–$C_{24}$ alkyl imidazolinium salt and wherein the cationic fabric softener and the hydrocarbon together comprise from 15% to 40% by weight of the composition.

7. A composition according to claim 6 wherein the hydrocarbon has from 12 to 24 carbon atoms.

8. A composition according to claim 7 wherein the hydrocarbon is a mixture of paraffins having from 14 to 18 carbon atoms.

9. A composition according to claim 6 wherein the ratio of cationic softener to hydrocarbon is from 1.25:1 to 1:3.

10. A textile treatment composition in aqueous medium and comprising a ternary active system consisting essentially of, by weight of said active system, (a) from 8% to 35% of water-insoluble cationic fabric softener;

(b) from 15% to 65% of a $C_{12}$–$C_{40}$ hydrocarbon; and (c) from 25% to 65% of a water-soluble cationic surfactant.

11. A composition according to claim 10 wherein the cationic fabric softener is selected from (1) compounds of the general formula $R_1R_2R_3R_4N^{(+)}X^{(-)}$ wherein $R_1$ and $R_2$ are each selected from $C_{12}$–$C_{24}$ alkyl, $R_3$ and $R_4$ are each selected from $C_1$–$C_4$ alkyl, and $X^{(-)}$ is an anion, (2) di $C_{12}$–$C_{24}$ alkyl imidazolinium salts and (3) mixtures thereof.

12. A composition according to claim 11 wherein the hydrocarbon is a paraffin or an olefin.

13. A composition according to claim 12 wherein the hydrocarbon has from 12 to 24 carbon atoms.

14. A composition according to claim 10 wherein the weight ratio of cationic softener to hydrocarbon is from 5:1 to 1:3.

15. A composition according to claim 10 wherein the wtaer-soluble cationic surfactant is a salt of the general formula

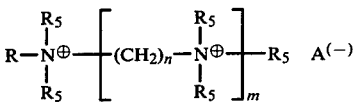

wherein R is selected from an alkyl or alkenyl group having from 10 to 24 carbon atoms in the alk(en)yl chain, and R—O—$(CH_2)_n$—; each $R_5$ is independently selected from hydrogen, —$(C_2H_4O)_pH$, —$(C_3H_6O)_qH$, —$(C_2H_4O)_r(C_3H_6O)_sH$, $C_{1-3}$ alkyl or the group —$(CH_2)_n$—$N(R')_2$, wherein R' is selected from hydrogen, —$(C_2H_4O)_pH$, —$(C_3H_6O)_pH$, —$(C_2H_4O)_p(C_3H_6O)_qH$ and $C_{1-3}$ alkyl; where n is an integer from 2 to 6; m is an integer from 1 to 5, each p,q,r and s is a number such that the total p+q+r+s in the molecule does not exceed 25; and, if in the salt or partial salt form, $A^{(-)}$ represents one or more anions having total charge balancing that of the nitrogen atoms.

16. A composition according to claim 15 wherein $R_5$ is —$(C_2H_4O)_pH$ and where p is 1 or 2.

17. A composition according to claim 10 wherein the said ternary active system is present in an amount of from 15% to about 40% by weight of the composition.

* * * * *